US005219239A

United States Patent [19]

Bianco

[11] Patent Number: 5,219,239

[45] Date of Patent: Jun. 15, 1993

[54] ROTATABLE BINDER INSERT

[75] Inventor: Ronald M. Bianco, Irvine, Calif.

[73] Assignee: Day Runner, Fullerton, Calif.

[21] Appl. No.: 702,222

[22] Filed: May 17, 1991

[51] Int. Cl.[5] ..... B42D 13/00

[52] U.S. Cl. ..... 402/79; 281/51; 283/117; 402/80 R

[58] Field of Search ..... 251/38, 51; 283/117; 402/79, 80 R, 80 P, 80 L

[56] References Cited

U.S. PATENT DOCUMENTS

| | | | |
|---|---|---|---|
| De. 311,220 | 10/1990 | Kam | D19/26 |
| 667,826 | 2/1901 | Mets | 248/458 |
| 2,287,390 | 6/1942 | Michael | 281/4 |
| 2,526,090 | 10/1950 | Slonneger et al. | 282/8 |
| 3,091,482 | 5/1963 | Cirigliano | 281/33 |
| 3,366,359 | 1/1968 | Wolf et al. | 248/447 |
| 3,557,474 | 1/1971 | Palmer | 40/10 |
| 4,049,119 | 9/1977 | Wilson | 402/79 X |
| 4,356,651 | 11/1982 | Barlow | 40/308 |
| 4,614,450 | 9/1986 | Neiman | 402/79 |
| 4,832,191 | 5/1989 | Gerver et al. | 206/232 |
| 4,981,386 | 1/1991 | Beleckis | 402/73 |
| 5,015,114 | 5/1991 | Miller | 402/79 X |
| 5,048,869 | 9/1991 | Schwartz | 402/80 R X |
| 5,058,736 | 10/1991 | Bedol | 206/214 |

FOREIGN PATENT DOCUMENTS

| | | | |
|---|---|---|---|
| 170723 | 5/1906 | Fed. Rep. of Germany | 281/42 |
| 2248693 | 5/1975 | France | 402/80 R |
| 2459142 | 2/1981 | France | 281/51 |
| 2587650 | 3/1987 | France | 281/45 |
| 70315 | 4/1946 | Norway | 281/42 |
| 215159 | 9/1967 | Sweden | 281/16 |
| 1280156 | 7/1972 | United Kingdom | 402/79 |

*Primary Examiner*—Paul A. Bell

*Attorney, Agent, or Firm*—Pretty, Schroeder, Brueggemann & Clark

[57] ABSTRACT

A rotatable binder insert for supporting and holding such articles as calculators or other electronic devices, to-do lists and check lists, self-stick removable notes, etc., that are used to supplement, or in conjunction with, information written on the pages of the binder. Inasmuch as such information may be found on both sides of the binder rings, i.e., on both right- and left-hand pages, an article used therewith must similarly be visible and accessible on alternate sides of the binder rings. By being mounted on a support member capable of rotating 180° on a frame insertable anywhere in the binder and readily attachable to the binder rings such articles can be placed alongside information found on either right or left-hand pages.

29 Claims, 2 Drawing Sheets

ROTATABLE BINDER INSERT

BACKGROUND OF THE INVENTION

The present invention relates to inserts for binders, and more particularly to inserts for supporting and holding such articles as calculators or other electronic devices, to-do lists and check lists, self-stick removable notes, and the like, that are used to supplement, or in conjunction with, information written on the pages of the binder For optimal convenience and accessibility, binder inserts of this type ought to be readily repositionable between selected pages of the binder and an article mounted thereon should be visible and readily accessible on either side of the binder center. Generally, simple inserts now in use, such as plastic page markers, dividers or rulers can be placed where needed within a binder, either by opening the binder rings and passing the rings through corresponding holes near the edge of the insert, or, if there are slots extending from these holes to the outer edge of the insert, by snapping the insert into the binder at the desired location.

However, if an article were to be supported by an appropriately sized but simple insert similar to those currently available, such an insert would hold it in only one position in which the holes for engaging the binder rings would always be on a predetermined side of the article. This arrangement would be satisfactory only if the written information being accessed were consistently found on one side of the rings. In other words, if the information being accessed were found on the front of each page attached to the binder rings through holes at the left margin, the calculator or other article to be used in conjunction with this information should be located on the opposite panel, attached to the binder rings by holes or detents near its right edge. Conversely, if the information being accessed were found on a page attached to the rings by holes in its right margin, for accessibility and ease of use the article should be mounted on the opposite panel, attached to the binder rings by holes or detents near its left edge.

In most situations however, written information is found on both sides of the binder rings. Thus, an insert of the above-mentioned type is not conveniently useable with all of the information. This drawback limits severely the utility of most binder inserts currently available. It should therefore be appreciated that there is a need for an improved binder insert for supporting and holding articles used to supplement, or in conjunction with, written information contained within a binder. The present invention fulfills that need.

SUMMARY OF THE INVENTION

The present invention improves the accessibility of an article supported and held by a binder insert by allowing the article to rotate on a frame attached to the binder rings, making it visible and accessible on either side of the binder center.

The present invention may be viewed as a combination of a conventional ring binder with two or more openable spring-loaded rings mounted on the inside of a spine connecting the front and back covers. A frame inserted into the binder releasably engages at least two binder rings. A support member rotatably mounted on the frame, and an article is supported and positioned on that support member. The support member can assume a first position in which the article is accessible on one side of the binder rings, and a second position in which the article is accessible on the opposite side of the binder rings, after the support member is rotated 180° on the frame, and the frame is turned 180° on the binder rings. The article is thus alternately visible and useable in conjunction with written information found on both right- and left-hand pages held by the binder rings.

The insert frame, which in itself forms one aspect of the invention, can have a variety of configurations mountable and rotatable on the binder rings and can be made of a variety of materials. The preferred frame is flat and U-shaped, molded from a semi-rigid thermoplastic material. A particularly advantageous U-shaped frame has a center portion extending along the binder rings and two end portions that extend perpendicularly from the center portion, away from the binder rings. Collectively these three portions of the frame define a generally rectangular opening in which a generally flat and rectangular support member is received. The center portion of the frame includes a main section of greater thickness defining one side of the opening and from which the two end portions emanate, and a thinner (either uniformly flat or tapering towards the outer edge) section extending from the main section towards the binder rings referred to here as the dorsum. That dorsum section of the frame defines apertures aligned with and sized to loosely receive the rings. These apertures can have slots extending from the aperture to the outer edge of the dorsum. These slots can have resilient detents which engage the binder rings. In effect the dorsum defines the slots and the apertures which allow the insert to be placed wherever it is needed within the binder, without opening the rings.

The support member is rotatably connected to the two end portions of the frame by pivots centered on its transverse edges so that it can assume a first position in which the article is accessible on one side of the binder rings, or a second position in which the article is accessible on the opposite side of the binder rings. A stop member molded integrally with the frame projects from the center portion of the frame and alternately engages a selected mating indent carried by the support member to retain the support member in either a left- or right-facing position.

It is to be noted that both the projections on which the support member pivots and the stop member may be formed integrally with either the support member or the frame, and mate with corresponding indents formed integrally within the opposing edge of either the frame or the support member. In addition, it will be apparent from the foregoing description that if the article to be used in an insert is an electronic calculator or similar device with a fairly rigid housing, that housing can be considered the support member of this invention.

Other features and advantages of the present invention will become apparent from the following detailed description, taken in conjunction with the accompanying drawings which illustrate, by way of example, the principles of the invention.

DESCRIPTION OF THE PREFERRED EMBODIMENT

An exemplary combination in accordance with the invention, shown in FIGS. 1 through 5, consists of an article 10, and an arrangement for supporting the article within a binder 12.

Figure 1:
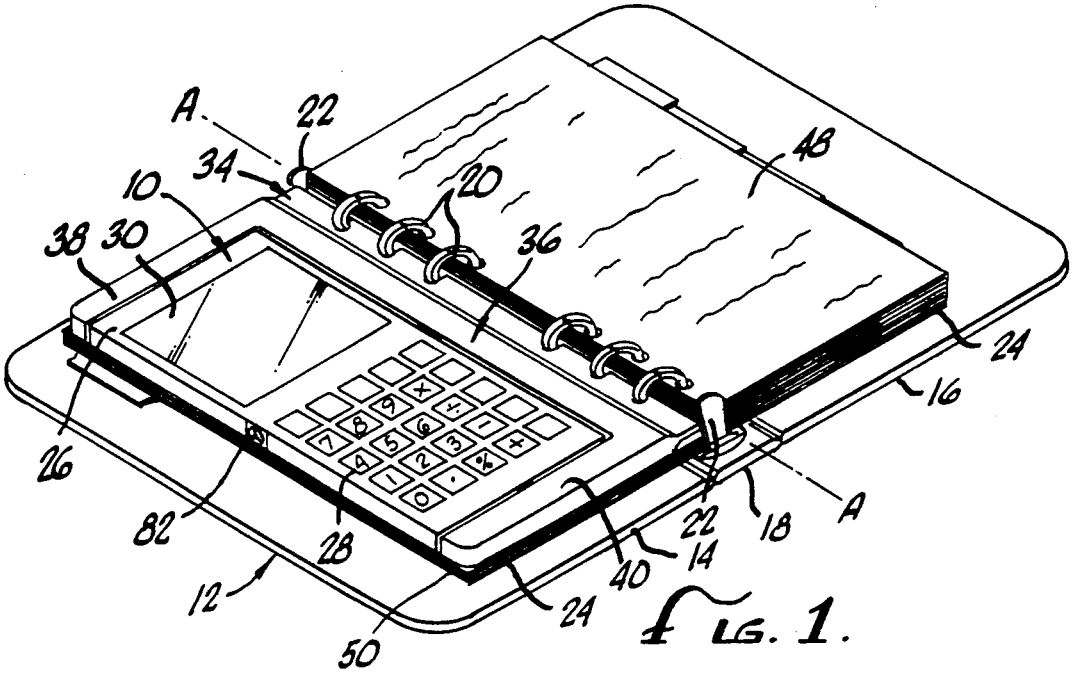
FIG. 1 is a perspective view of a binder with a calculator rotatably mounted within a frame, and positioned to the left of the binder rings.
Figure 2:
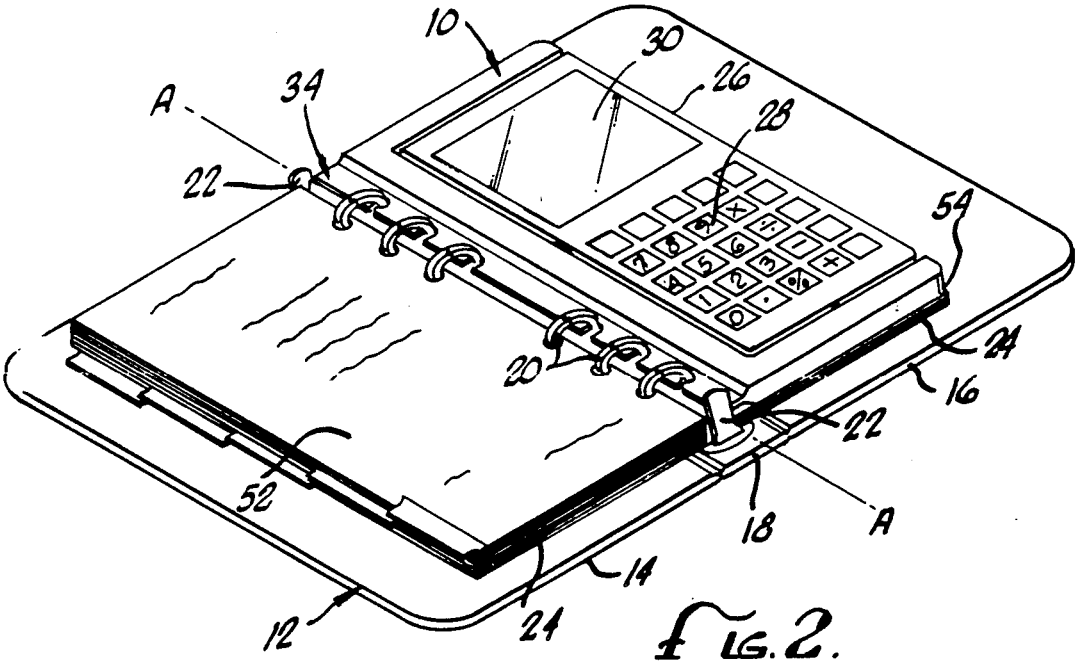
FIG. 2 is a perspective view of a binder shown in FIG. 1, with the calculator rotated 180° and the frame positioned to the right of the binder rings.

The binder 12, shown in FIGS. 1 and 2, is of a common variety having two rigid, rectangular panels 14 and 16 forming front and back covers that are each hingedly connected along one edge to an elongated spine 18. A plurality of similar openable metal rings 20 that are spring-loaded, are evenly spaced along the spine 18, being positioned on an axis A—A that extends longitudinally along the center of the spine. The rings 20 can be opened and closed by depressing or raising two tabs 22 at opposite ends of the spine 18, in the conventional manner. The binder contains a plurality of rectangular paper pages 24 that fit between the covers 14 and 16 and have holes punched therein that receive the rings 20. Thus, the pages 24 can be turned individually when the rings 20 are closed, and can be removed by opening the rings.

Figure 3:
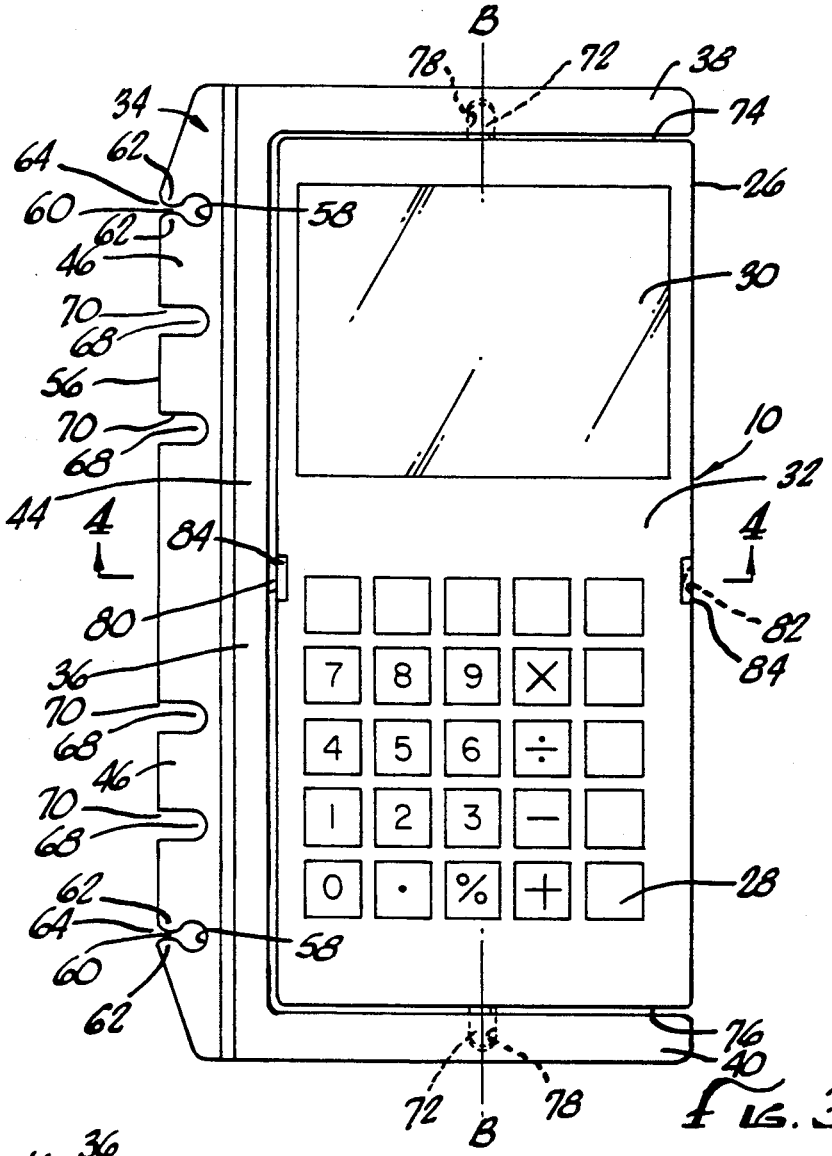
FIG. 3 is a front view of a calculator within a frame with mounting holes in its left margin.
Figure 4:
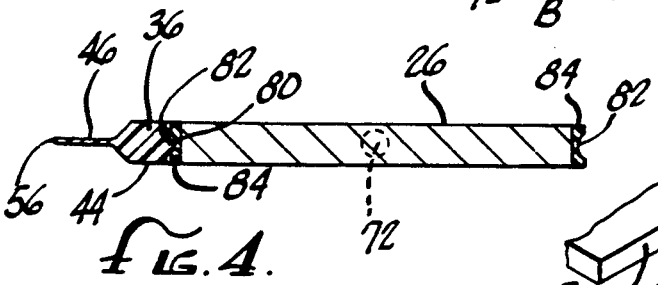
FIG. 4 is a cross-sectional view of the calculator and the frame taken along line 4—4 of FIG. 3.

The article 10 is a calculator contained within a housing 26. The housing 26, which for purposes hereof is considered a separate element from the calculator itself, forms a support member for the calculator, i.e., the calculator components. The calculator 10, like the binder 12, is of a conventional variety, and is shown in FIG. 3. The housing 26 is generally thin, flat, rectangular, and plastic, having operating buttons 28 and a display 30 (that form part of the calculator) accessible on one side 32.

It is intended, in accordance with the invention, that the calculator be used in conjunction with the written contents of the binder pages 24. It should be understood that, instead of a calculator 10, the article can be of a different nature. For example, it can be another type of electronic device such as a data storage device, a spell-checker, a dictionary, etc.

The housing 26 is held within the binder 12 by an insert 34. This insert 34 is of molded plastic construction, being generally U-shaped with rounded outer corners for ease of handling and an attractive appearance. It has a center portion 36 that extends along and parallel to the axis A—A of the rings 20 and two integrally formed end portions 38 and 40 that extend perpendicularly from the top and bottom of the center portion 36 and away from the rings 20, thus defining a large, generally rectangular opening into which the rectangular housing 26 is disposed. The size and shape of the insert 34 is such that it conforms to, or is slightly smaller than the pages 24 that it overlies when in use.

The center portion 36 of the insert 34 includes a relatively thick main section 44, and a dorsum or fin-like section 46 of reduced thickness that extends from the main section toward the rings 20 of the binder and away from the end portions 38 and 40. This dorsum 46, which extends along the entire length of the main portion, defines a plurality of circular apertures that correspond in size, number and position to the rings 20 of the binder 12, thus allowing the insert 34 to be placed and held within the binder between the selected pages, such as the pages 48 and 50 of FIG. 1 or the pages 52 and 54 of FIG. 2.

Figure 5:
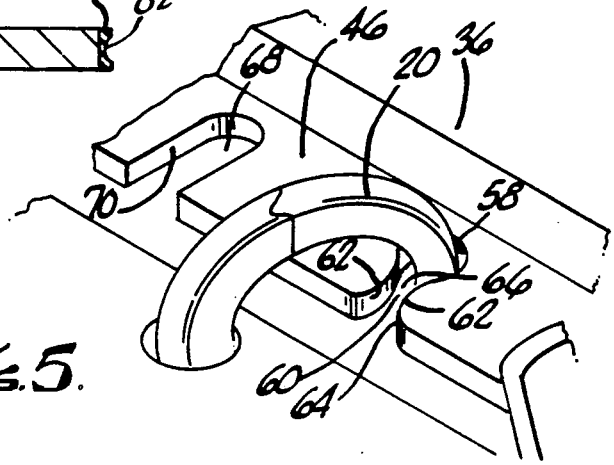
FIG. 5 is an enlarged perspective view, partly in cut-away section, of a typical aperture and detents in the dorsum of the frame mounted on a binder ring.

In this embodiment there are six apertures in the dorsum 46 aligned with and sized to receive the rings 20 of the binder 12. Each of the six apertures is connected to the linear outer edge 56 of the dorsum 46 by one of two types of slots. The two most widely separated apertures 58, closest to the top and bottom of the insert, respectively, have slots 60 referred to as the retaining slots, as it is their function to retain the insert 34 within the binder 12. They are defined by two opposing resilient detents 62 that are mirror images of each other, as best shown in FIG. 5. Each detent 62 is a generally rounded projection of arcuate profile that is integrally formed with the surrounding portion of the dorsum 46. Thus, each retaining slot 60 has a relatively wide entry portion 64 through which the ring 20, upon insertion, is guided toward a narrower throat portion 66, being automatically centered by the curvatures of the detents 62. The four remaining apertures 68 have slots 70 known as positioning slots, as they do serve a positioning function but do not serve, by themselves, to retain the insert 34 in the binder. The positioning slots 70 lack detents, are generally straight sided and wider than the rings 20, allowing the rings 20 to pass through them freely. The plastic of which the insert 34 is made is selected for its resilient, non-brittle properties. The main section 44 of the center portion and the end portions 38 and 40, being of substantially greater thickness than the dorsum 46, although formed of the same material, render the insert 34 more rigid and durable.

It is important that the retaining slots 60 be of a minimum width at their throat, which is less than the diameter of the apertures 58 and less than the thickness of the binder rings 20. It is thus possible to snap the insert 34 into the binder 12 without opening the rings 20 by aligning the slots 60 and 70 with the rings 20 and applying pressure until the detents 62 are resiliently deformed, allowing the rings 20 to pass through the throats 66 of the retaining slots 60 into the apertures 58, while positioning slots 70 loosely accept the corresponding rings 20. Similarly, the insert 34 can be removed by pulling it away from the binder, thus causing the detents 62 to again deform, after centering the rings, and allowing the rings 20 to pass fully through the retaining slots 60.

It should be noted that this snap-in and snap-out feature of the invention provides for considerable convenience when using the insert 34, as it is not necessary to open the rings 20 when it is desired to remove the insert 34 from its position between the pages 48 and 50 of FIG. 1, for example, and re-insert it between the pages 52 and 54 of FIG. 2.

The calculator housing 26 has two cylindrical projections 72 that are each rounded at the top, formed integrally with the housing and extend outwardly from the centers of the top and bottom housing edges 74 and 76, respectively. These projections are aligned with and fit closely into correspondingly sized, generally cylindrical cavities 78 in the upper and lower end portions 38 and 40, respectively, of the insert 34. When the projections 72 are inserted into the cavities 78 they function as pivots on which the housing is rotatably mounted on the insert 34 and define an axis B—B, parallel to the axis A—A of the binder rings 20, about which the calculator 10 is rotatable relative to the insert 34.

A convex protrusion 80 in the middle of the inward-facing vertical edge of the insert 34 center portion 44 is molded integrally with the insert and is referred to here as the stop member. When the calculator housing 26 lays flat within the insert 34, the stop member 80 serves to restrain the housing 26 from rotating freely by resiliently engaging either of two concave depressions 82 within the mating indents 84 at the center of both the left and right edges of the calculator housing.

The sequence of steps employed in using the present invention depends to some degree on the prior location of the insert within the binder 12 and the orientation of the housing 26 relative to the insert 34. Specifically, the insert 34 may already be inserted in front of the correct page (the page 48 of FIG. 1 or the page 52 of FIG. 2), or it may be inserted elsewhere within the binder 12. In either case, the housing 26 may face the correct page (the page 48 of FIG. 1 or the page 52 of FIG. 2) or away from it (the page 50 of FIG. 1 or the page 54 of FIG. 2).

If the insert 34 is already in front of the page on which the requisite information is found (such as the page 48 of FIG. 1), and the housing 26 is facing that page (as it does in FIG. 1), all that remains is to open the binder 12 between that page and the insert 34, so that the correct page is one side of the rings 20 while the calculator 10 is on the other side of the rings 20, making both visible and conveniently useable. Similarly, if the requisite information were found on the page 52 of FIG. 2, all that remains to be done is to open the binder 12 between the correct page (the page 52 of FIG. 2) and the insert 34, so that the required page is on one side of the rings 20 and the calculator 10, is on the other side of the rings, facing that page.

The second possibility is that while the insert 34 may already be located adjacent to the appropriate page, (the page 50 in FIG. 1 or the page 54 of FIG. 2), the housing 26 is turned away from that page and faces the page beneath the insert 34 (the page 48 in FIG. 1 or the page 52 in FIG. 2). Under these circumstances all that is required is to re-orient the housing 26 so that it faces the correct page (the page 50 in FIG. 1 or the page 54 in FIG. 2). This is best accomplished by lifting the free end of the insert 34 along with the housing without pulling the dorsum 46 off the rings 20 so that the insert is roughly perpendicular to the covers 14 and 16 of an open binder 12, and while holding the insert 34, applying sufficient lateral force near the left or right edge of the housing 26 to disengage the stop member 80 from the depression 82 within the mating indent 84 on one side of the housing, rotate the housing 180° clockwise or counterclockwise about the B—B axis, and engage the stop member 80 with the mating depression on the opposite side of the housing. At this point the insert 34 and the housing 26 within it may be laid flat, on the other side of the rings 20, across from the page being accessed (the page 50 in FIG. 1 or the page 54 in FIG. 2), making the calculator available for use in conjunction with information found on that page.

The third possibility is that the insert 34 is mounted on the rings 20 somewhere other than adjacent to the page containing the requisite information, (for example the insert may be mounted adjacent to the page 50 of FIG. 1 whereas the required information is found on the page 52 of FIG. 2), and the calculator is oriented towards the correct page. The fourth and last possibility is that the insert 34 is mounted in the binder 12 somewhere other than adjacent to the page containing the requisite information and the calculator 10 is facing away from the correct page (for example the insert could be needed for use with information found on the page 52 of FIG. 2 whereas it is located next to and facing the page 48 of FIG. 1).

The first step in rectifying either of the latter two situations is to remove the insert 34 from the binder 12 in order to make it available for reinsertion where it is needed. This is accomplished by pulling on the housing 26 or the insert 34 with sufficient force to deform the detents 62 of the retaining slots 60 allowing the rings 20 to pass through these slots, thereby releasing the insert from the rings 20 and the binder 12. The insert 34 is then introduced in front of the page containing the information to be used in conjunction with the calculator 10 (such as the page 52 of FIG. 2), with the dorsum 46 pointing towards the rings 20. Once the retaining slots 60 and the positioning slots 70 in the dorsum 46 are aligned with the respective rings 20, sufficient inward pressure is applied to the housing 26 or the insert 34 to deform the detents 62 in the retaining slots 60 to allow the rings 20 to pass through the throat 66 of the retaining slots 60 and be received by apertures 58. At this point the insert 34 is located next to the correct page (the page 52 of FIG. 2) and the calculator 10 may be facing that page (as it does in FIG. 2), in which case the task of placing the calculator 10 alongside information found on that page is accomplished. If, on the other hand, the required information is found on the page at the back of the housing face 32 (such as the page 54 of FIG. 2) then the steps to rotate the housing on the insert outlined in the second situation are repeated here.

As will be appreciated from the above description, the present invention allows an article such as an electronic calculator to be seen and conveniently used alongside information printed on either left-hand or right-hand pages held within a binder, on the opposite side of the binder rings.

While a particular form of the invention has been illustrated and described, it will be apparent that various modifications can be made without departing from the spirit and scope of the invention. Accordingly, it is not intended that the invention be limited, except as by the appended claims.

I claim:

1. The combination comprising:

a binder having a front cover and a back cover that are hingedly connected to an elongated spine and a plurality of openable rings spaced longitudinally along said spine for releasably retaining pages;

a frame inserted in said binder having a dorsum, said dorsum defining a first longitudinal portion having a longitudinal outer edge and defining a plurality of slots extending inwardly from said outer edge for loosely receiving said rings and having a plurality of resilient detents that partially define at least two of said slots to permit the dorsum to be snapped into or out of the rings such that when said dorsum is snapped into the rings said outer edge is inside the rings;

said frame further having a center portion and two end portions that extend perpendicularly from said center portion, said center portion and end portions defining a generally rectangular opening;

an article to be used with said binder;

a support member on which said article is supported and positioned, said support member being mounted within said opening of said frame; and pivot means between said support member and each end portion and centered traversely with respect to said support member for permitting the support member to rotate 360 degrees within said opening, whereby said support member can assume a first position in which said article is accessible on one side of said rings and a second position in which said article is accessible on the opposite side of said rings after rotation of said support member on said frame and rotation of said dorsum on said rings.

2. The combination as defined in claim 1, wherein said frame is generally U-shaped, said center section defines a second longitudinal portion secured to and relatively thicker than said first longitudinal portion of said dorsum and said two end portions extend perpendicularly away from said rings.

3. The combination as defined in claim 2 wherein:

said U-shaped frame is generally flat and said support member is generally flat, rectangular and fits within said opening.

4. The combination as defined in claim 1, further comprising stop means for selectively retaining said support member in said first position in which said article is accessible on one side of said rings and in said second position in which said article is accessible on the opposite side of said rings.

5. The combination as defined in claim 1, wherein said frame and said support member are molded of a semi-rigid thermoplastic material.

6. The combination as defined in claim 1, wherein said article is an electronic data processing device.

7. The combination as defined in claim 1, wherein said support member forms a housing for said article.

8. The combination as defined in claim 7, wherein said article is an electronic data processing device.

9. The combination as defined in claim 8, wherein said electronic data processing device is an electronic calculator.

10. The combination as defined in claim 1, wherein:

said pivot means include projections on opposite edges of said support member, formed integrally with said support member; and said projections are received by recesses defined by said end portions.

11. The combination of a binder, an article to be used therewith and an arrangement for supporting said article, the combination comprising:

a binder with openable rings means for releasably retaining pages, said ring means comprising a plurality of openable, spring-loaded rings;

a generally U-shaped flat frame, molded of semi-rigid thermoplastic material, having a center portion extending along said ring means that includes ring engagement means comprising a plurality of slots aligned with said rings, resilient detents partially defining said slots for releasably attaching to said rings, said slots culminating in apertures defined by said center portion and sized to loosely receive said rings, and two end portions that extend perpendicularly from said center portion, said center portion and end portions defining three sides of a generally rectangular opening;

a generally flat rectangular support member disposed within said opening, and conforming generally to the size and shape thereof and molded of semi-rigid thermoplastic material, said article being supported and positioned on said support member;

pivot means by which said support member is rotatably mounted on said frame, whereby said support member can assume a first position in which said article is accessible on one side of said ring means and a second position in which said article is accessible on the opposite side of said ring means after rotation of said support member on said frame and frame rotation on said ring means; and stop means for selectively retaining said support member in either said first position or said second position.

12. An insert for a ring binder having a plurality of rings to support an article to be used with said ring binder, said insert comprising:

a frame having a center portion and two end portions that extend perpendicularly from the center portion to define a generally rectangular opening, said center portion having ring engagement means for engaging at least some of said rings;

a support member disposed in said generally rectangular opening on which said article is supported and positioned, said support member being rotatably mounted on said frame, whereby said support member can assume a first position in which said article is accessible on one side of said rings and a second position in which said article is accessible on the opposite side of said rings; and stop means for selectively retaining said support member in said first position in which said article is accessible on one side of said rings and said second position in which said article is accessible on the opposite side of said rings.

13. The insert as defined in claim 12 wherein said stop means comprises a protrusion on one of said frame and support member and a mating depression on the other of said frame and support member.

14. The insert as defined in claim 12, wherein said frame is generally U-shaped.

15. The insert as defined in claim 14, wherein:

said U-shaped frame is generally flat and said support member is generally flat.

16. The insert of claim 12, further comprising pivot means for rotatably connecting said support member to said end portions, said pivot means being centered transversely with respect to said support member.

17. The insert as defined in claim 16, wherein:

said pivot means includes projections on opposite edges of said support member, formed integrally with said support member; and said projections are received by recesses defined by said end portions.

18. The combination comprising:

a binder with openable ring means for releasably retaining pages;

a frame having a center portion, an upper end portion and a lower end portion, one of said end portions extending perpendicularly from each end of the center portion, said end portions disposed parallel to each other and defining an opening therebetween, said frame having ring engagement means for engaging at least some of said rings;

an article;

a support member on which said article is supported and positioned, said support member disposed in said opening between said end portions such that a top edge of said support member is adjacent the upper end portion and a bottom edge of said support member is adjacent the lower end portion; and pivot means centered traversely with respect to the top edge and bottom edge of the support member for permitting the support member to rotate 360 degrees within said opening about an axis passing through the top edge and the bottom edge of the support member, whereby said support member can assume a first position in which said article is accessible on one side of said ring means and a second position in which said article is accessible on the opposite side of said ring means.

19. The insert as defined in claim 18 wherein said frame is generally U-shaped and said center portion of the frame includes the ring engagement means for engaging the rings of a ring binder.

20. The insert as defined in claim 19, wherein:

said frame is generally flat and defines a generally rectangular opening; and said support member is generally flat and rectangular and fits within said opening.

21. The insert as defined in claim 20, wherein said pivot means including pivots rotatably connecting said support member to said frame.

22. The combination as defined in claim 21, wherein said pivots are projections located on said top and bottom edges of said support member and formed integrally with said support member.

23. The insert as defined in claim 18, further comprising stop means for selectively retaining said support member in said first position in which said article is accessible on one side of said rings and said second position in which said article is accessible on the opposite side of said rings.

24. The insert as defined in claim 19, wherein said ring engagement means comprises:

a plurality of apertures sized to loosely receive said rings;

a plurality of slots leading to said apertures; and a plurality of resilient detents that partially define said slots.

25. The combination as defined in claim 18, wherein said frame and said support member are formed of a semi-rigid plastic material.

26. The insert as defined in claim 18 wherein the axis is perpendicular to the top edge and bottom edge of the support member.

27. The insert as defined in claim 18, wherein said pivot means are centered traversely at the center of the top and bottom edges of the support member.

28. The insert as defined in claim 18, wherein said pivot means are centered traversely such that a front surface of said article is accessible to a user at adjacent locations on either side of the ring means.

29. The insert as defined in claim 18, wherein the center portion of the frame is closely adjacent to a first side of the support member in the first position and is closely adjacent to a second opposite side of the support member in the second position.

* * * * *